US007196009B2

(12) United States Patent
Bex et al.

(10) Patent No.: US 7,196,009 B2
(45) Date of Patent: Mar. 27, 2007

(54) LAPPING CARRIER, APPARATUS FOR LAPPING A WAFER AND METHOD OF FABRICATING A LAPPING CARRIER

(75) Inventors: Brian L. Bex, Camas, WA (US); David K. Chen, Camas, WA (US)

(73) Assignee: SEH America, Inc., Vancouver, WA (US)

( * ) Notice: Subject to any disclaimer, the term of this patent is extended or adjusted under 35 U.S.C. 154(b) by 232 days.

(21) Appl. No.: 10/434,772

(22) Filed: May 9, 2003

(65) Prior Publication Data

US 2004/0224522 A1 Nov. 11, 2004

(51) Int. Cl.
*H01L 21/302* (2006.01)

(52) U.S. Cl. ..... 438/691; 438/692; 438/693; 451/402; 451/403

(58) Field of Classification Search ..... 438/691, 438/692, 693; 451/402, 403
See application file for complete search history.

(56) References Cited

U.S. PATENT DOCUMENTS 4,739,622 A * 4/1988 Smith ..... 62/78
5,422,316 A 6/1995 Desai et al.
5,914,053 A 6/1999 Masumura et al.
6,030,280 A * 2/2000 Fruitman ..... 451/291
6,042,688 A 3/2000 Masumura et al.
6,454,635 B1 9/2002 Zhang et al.
6,514,424 B2 2/2003 Wenski et al.
6,733,723 B2 * 5/2004 Choi et al. ..... 419/26

FOREIGN PATENT DOCUMENTS

JP 359024960 A * 2/1984

* cited by examiner

*Primary Examiner*—Nadine G. Norton
*Assistant Examiner*—Binh X. Tran
(74) *Attorney, Agent, or Firm*—Alston & Bird LLP

(57) ABSTRACT

A method of fabricating a lapping carrier is provided that includes the steps of defining at least one opening extending through a workpiece that is sized to receive a wafer, and cryogenically tempering the workpiece to produce a lapping carrier. By cryogenically tempering the workpiece, the conversion of the crystalline structure of the workpiece to a martensite crystalline structure is enhanced, thereby improving the hardness of the lapping carrier. A lapping carrier is also provided that has a crystalline structure, of which at least 70% is a martensite crystalline structure. An apparatus for lapping a wafer is further provided that includes a hardened lapping carrier and at least one lapping plate proximate the lapping carrier for lapping wafer(s) disposed within the at least one opening defined by the lapping carrier.

10 Claims, 2 Drawing Sheets

LAPPING CARRIER, APPARATUS FOR LAPPING A WAFER AND METHOD OF FABRICATING A LAPPING CARRIER

FIELD OF THE INVENTION

The present invention relates generally to lapping carriers and an associated method of fabrication and, more particularly, to lapping carriers that have been cryogenically tempered to increase their hardness and to correspondingly reduce the rate at which the lapping carriers wear once in use.

BACKGROUND OF THE INVENTION

The manufacture of wafers, such as silicon wafers, involves a number of sequential steps to produce a wafer that meets that exacting specifications of the various device manufacturers. Initially, a crystalline ingot is grown, such as by the Czochralski method. The crystalline ingot is sliced into a plurality of wafers. The edge of each wafer is then generally ground to properly size the wafer and to impart the desired profile, such as a rounded or chamfered profile, to the edge of the wafer. The opposed major surfaces of the wafer are then lapped to the desired thickness while planerizing the wafer by reducing thickness variations and improving flatness across each major surface. The opposed major surfaces are then typically etched so as to reduce the number of surface defects, before polishing at least one of the major surfaces to have the desired mirrored finish.

In order to lap a wafer, lapping machines are utilized. Lapping machines generally include a lapping carrier that defines at least one, and more commonly, a plurality of openings sized to receive respective wafers. The lapping machine also includes a pair of lapping plates disposed on opposite sides of the lapping carrier. Since the lapping carrier is slightly thinner than the wafers, the opposed surfaces of the wafer contact the lapping plates. As such, relative movement of the lapping carrier with respect to the lapping plates removes material from the opposed surfaces of the wafers, thereby lapping the wafers. In order to facilitate the lapping of the opposed surfaces of the wafers, a slurry is generally disposed between the lapping plates and the lapping carrier.

In a conventional lapping machine, multiple wafers are concurrently lapped in a batch process. Thus, the lapping carrier preferably defines a plurality of openings for receiving respective wafers. In addition, the lapping plates may be much larger than a lapping carrier such that multiple lapping carriers can be simultaneously disposed between the pair of lapping plates. In order to provide for the relative motion between the lapping plates and the lapping carriers that is necessary to lap the wafers, conventional lapping machines include an inner sun gear and an outer ring gear. Correspondingly, the lapping carriers generally include gear teeth that extend circumferentially thereabout and radially outward for engaging the inner sun gear and the outer ring gear. By appropriately driving at least one of the inner sun gear and the outer ring gear, the lapping carriers and, in turn, the wafers carried by the lapping carriers will move in a somewhat eccentric pattern between the opposed lapping plates with the wafers rotating freely within the respective openings.

Lapping carriers generally have a circular shape. Lapping carriers may have various diameters with diameters of 20", 22", 30", and 32" being relatively common. Lapping carriers are generally formed of steel and, as explained below, are typically formed of relatively hard grades of steel with hardness in the range of Rockwell C 40 to 50. The sheet steel utilized to construct lapping carriers must generally be custom fabricated since the steel must not only be hard, but the opposed surfaces of the lapping carrier must be extremely flat to facilitate the proper lapping of the wafers. In this regard, the thickness of a lapping carrier is generally subject to a very tight tolerance, such as a tolerance permitting variations in thickness of no more than +/−0.02 mm. For smaller lapping carriers, such as those lapping carriers having a diameter of 20" or 22", sheet steel that has been heat treated to attain a hardness ranging from Rockwell C 40 to 50, and that meets the dimensional requirements is readily available and may be purchased relatively economically. For larger lapping carriers, such as lapping carriers having a diameter of 30" or more, however, sheet steel that meets the dimensional requirements and that has been heat treated to have the desired hardness is extremely rare due to a lack of available manufacturing sources. As the width requirement of the steel increases for larger lapping carriers having a diameter of 30" or more, it becomes increasingly difficult for steel producers to achieve the desired thickness tolerance, and the manufacturing infrastructure for heat treating of such dimension becomes extremely rare. The lack of industry supply makes the sheet steel of the desired hardness prohibitively expensive. As such, these larger lapping carriers are generally formed of a softer grade of hard rolled steel like: SK-5 (JIS Standard), W1–8 (AISI/ASTM Standard), and 1074/1075/1086 (SAE Standard), which is more economical, but will wear more rapidly as a result of being softer.

In a typical process for fabricating a lapping carrier, openings are punched through a circular steel workpiece with the diameter of the openings being slightly larger than the diameter of the wafers such that wafers can be seated within respective openings. The edge of these openings are typically polished to facilitate rotation of the wafers within the respective openings. Additionally, the gear teeth are formed about the circumference of the circular workpiece, such as by punching or by laser cutting. For the smaller lapping carriers, since the workpiece is generally formed of a relatively hard material, the difficulty associated with forming the openings and the gear teeth may be somewhat increased.

During the lapping process, a wafer generally freely rotates within the respective opening defined by the lapping carrier in order to evenly lap the wafer as required to obtain the desired flatness. During this process, the wafer repeatedly contacts the edge of the opening. This contact between the edge of the opening and a wafer causes the edge of the opening to gradually degrade or erode. This degradation of the opening may cause the edge of the opening to become grooved and roughened, as opposed to a flat and smooth edge as desired. The degraded edge of an opening impedes rotation of the wafer, thus causing the wafer to be lapped more unevenly and decreasing the flatness of the resulting wafer. The degraded edge of the opening may also damage the edge of the wafer, thereby increasing the possibility that the edge of the wafer will chip. As the edge of the openings defined by the lapping carrier further erodes, wafers may actually become dislodged from the respective openings during lapping operations. In this instance, the lapping operations would crash and the lapping machine would need to be halted, disassembled, cleaned and potentially the lapping carrier would need to be replaced, prior to being returned to service. Since the rate at which the edge of the opening degrades is based, at least in part, upon the hardness of the lapping carrier, larger lapping carriers that are generally formed of softer grades of steel typically experience erosion of the edge of the openings at a quicker rate than that experienced by smaller lapping carriers that are generally formed of harder grades of steel In order to maintain the relatively free rotation of wafers within the openings defined by a lapping carrier and to avoid the deleterious effects occasioned by the degradation of the edge of the openings defined by the lapping carrier, lapping carriers are periodically replaced. In this regard, degradation of the edge of the openings of a lapping carrier is the most common reason for replacing a lapping carrier. However, lapping carriers are also replaced because of undesirable thinning of the lapping carrier. In this regard, the lapping process in which the opposed surfaces of the wafers are lapped by a polishing slurry also removes material from the opposed surfaces of the lapping carrier. While the lapping carriers are designed to be somewhat thinner than the desired thickness of the wafers, such as about 5 microns to about 100 microns thinner, a lapping carrier is no longer usable if the lapping carrier becomes substantially thinner than the wafers. As will be apparent, the replacement of a lapping carrier increases the capital costs associated with the lapping process since lapping carriers are relatively expensive, while slowing the overall fabrication process that must be temporarily halted in order to replace the lapping carrier.

In order to reduce the damage on the edge of the wafer caused by the degradation of the edge of the openings defined by a lapping carrier, lapping carriers have been designed having injection molded plastic rings or manually applied plastic inserts that are fitted to the edge of the openings. See, for example, U.S. Pat. No. 6,454,635 Zhang, et. al, U.S. Pat. No. 6,514,424 to Guido Wenski et al. and U.S. Pat. No. 5,914,053 to Masumura, et al. The plastic rings and inserts create a smooth and buffered contact surface within the opening of lapping carrier, which reduce the effect of the impact force generated between the wafer and the edge of the opening of the carrier during lapping. This helps reduce the possibility of wafer chipping, while promoting free rotation of the wafer. However, since of the plastic rings and inserts are softer than the steel, the rate of erosion of the edge of the openings defined by the lapping carrier will be faster than that of steel. As such, lapping carriers with injection molded plastic rings must be replaced at shorter service life than standard carrier, while lapping carriers with manually applied plastic inserts must be taken off-line more frequently to have the insert reapplied. With respect to at least the larger lapping carriers that are generally formed of a softer grade of steel, the lapping carriers may also bend more easily during use or general handling, thereby weakening the bond between the plastic ring or insert and the lapping carrier in instances in which the plastic ring or insert is adhered to the edge of a respective opening.

It would therefore be desirable to provide a lapping carrier constructed from an economical and widely available material that can be cryogenically enhanced to achieve a longer useful life. In this regard, it would be desirable to provide a lapping carrier having openings with edges that are not degraded as quickly and having a thickness that does not decrease as rapidly during lapping in comparison to conventional lapping carriers. Furthermore, with respect to lapping carriers with manually applied plastic inserts, it would be desirable to provide a lapping carrier with a reduced rate of wear on the steel carrier body. This allows for repeated application of manually applied plastic inserts, thus further extending the service life of that carrier, and reducing overall capital cost. Lastly, it would be desirable to provide a lapping carrier whose hardness is not constrained by the manufacturing capability of steel manufacturer, but can be substantially manipulated during the manufacturing of the lapping carrier to achieve a martensite crystalline structure of at least 70%, and more advantageously at least 90%, and even more advantageously at least about 99%. This will provide greater flexibility for the procurement of raw material in terms of price, quality, availability, and timeliness of delivery.

SUMMARY OF THE INVENTION

According to one embodiment to the present invention, a method for fabricating a lapping carrier is provided in which the lapping carrier is cryogenically tempered in order to advantageously increase the hardness of the lapping carrier. According to another aspect of the present invention, a lapping carrier and an associated apparatus for lapping a wafer are provided in which the lapping carrier has a crystalline structure with at least 70% of the crystalline structure comprising a martensite crystalline structure, such as a result of the cryogenic tempering of the lapping carrier. As such, the lapping carrier of these aspects of the present invention may have increased hardness relative to conventional lapping carriers formed of the same material. By hardening the lapping carrier through a cryogenic tempering process, the lapping carrier can also be formed of a material that initially is softer but is then hardened by cryogenic tempering, thereby permitting the lapping carrier to be formed of a less expensive material that is easier to process. By increasing the relative hardness of the lapping carrier, the lapping carrier has a longer useful life since the edge of the openings defined by the lapping carrier does not erode as quickly and since the lapping carrier does not thin as quickly. Since the edge of the openings defined by lapping carrier does not erode as quickly as conventional lapping carriers, the wafers will continue to rotate freely within the openings to maintain the desired flatness of the wafers and to minimize the possibility of wafer edge chipping.

According to one aspect of the present invention, a method of fabricating a lapping carrier is provided that includes the steps of defining at least one opening extending through a workpiece that is sized to receive a wafer, and cryogenically tempering the workpiece to produce a lapping carrier. These steps may be performed in either order such that the openings are defined by the workpiece before cryogenically tempering the workpiece or after the workpiece has already been cryogenically tempered. In one embodiment, the workpiece is cryogenically tempered by subjecting the workpiece to a plurality of thermal cycles with at least one thermal cycle conducted at a cryogenic temperature. In this regard, the workpiece may be heat treated prior to subjecting the workpiece to the cryogenic temperature to facilitate conversion of the crystalline structure of the workpiece to a martensite crystalline structure. By cryogenically tempering the workpiece, at least 70% and, more commonly at least about 99% of the crystalline structure of the workpiece is converted to a martensite crystalline structure. As such, the hardness of the lapping carrier is improved.

At least one of the openings defined by the workpiece may be formed by punching. In order to reduce any roughening of the edge of the wafer that may be caused by contact between the edge of the wafer and the edge of the respective opening, the edge of the openings defined by the workpiece may be polished.

According to another aspect of the present invention, a lapping carrier is provided that includes a carrier body defining at least one and, more commonly, a plurality of openings that are sized to receive respective wafers. According to this embodiment, the carrier body has a crystalline structure with at least 70% and, more commonly, at least about 99% of the crystalline structure comprising a martensite crystalline structure. The carrier body may also include a plurality of teeth disposed about the periphery thereof, thereby facilitating the relative movement of the lapping carrier between a pair of lapping plates.

According to yet another aspect of present invention, an apparatus for lapping a wafer is provided that includes a lapping carrier defining at least one opening for receiving a respective wafer and having a crystalline structure with at least 70%, and, more commonly, at least about 99% of the crystalline structure comprising a martensite crystalline structure. The apparatus of this aspect of the present invention also includes at least one lapping plate proximate the lapping carrier for lapping the respective wafer disposed within the at least one opening defined by the lapping carrier. The apparatus may be configured for double sided lapping by providing a lapping carrier with at least one opening extending completely therethrough, and by including a pair of lapping plates disposed on opposite sides of a lapping carrier so as to contact the opposed surfaces of the wafers.

According to the present invention, a method of fabricating a lapping carrier is provided that includes the cryogenic tempering of the lapping carrier, thereby converting the vast majority of the lapping carrier to a martensite crystalline structure which, in turn, hardens the lapping carrier. As such, the edges of the openings defined by the lapping carrier will erode more slowly than conventional lapping carriers formed of the same material. Additionally, the thickness of the lapping carrier will be reduced at a slower rate. As such, the lifetime of a lapping carrier of the present invention should be extended, thereby reducing the capital costs associated with lapping wafers and decreasing the time that the lapping apparatus must be offline in order to replace the lapping carrier. The workpiece may also be formed of a somewhat softer material that is less expensive and easier to process since the cryogenic tempering will thereafter significantly increase the hardness of the workpiece.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
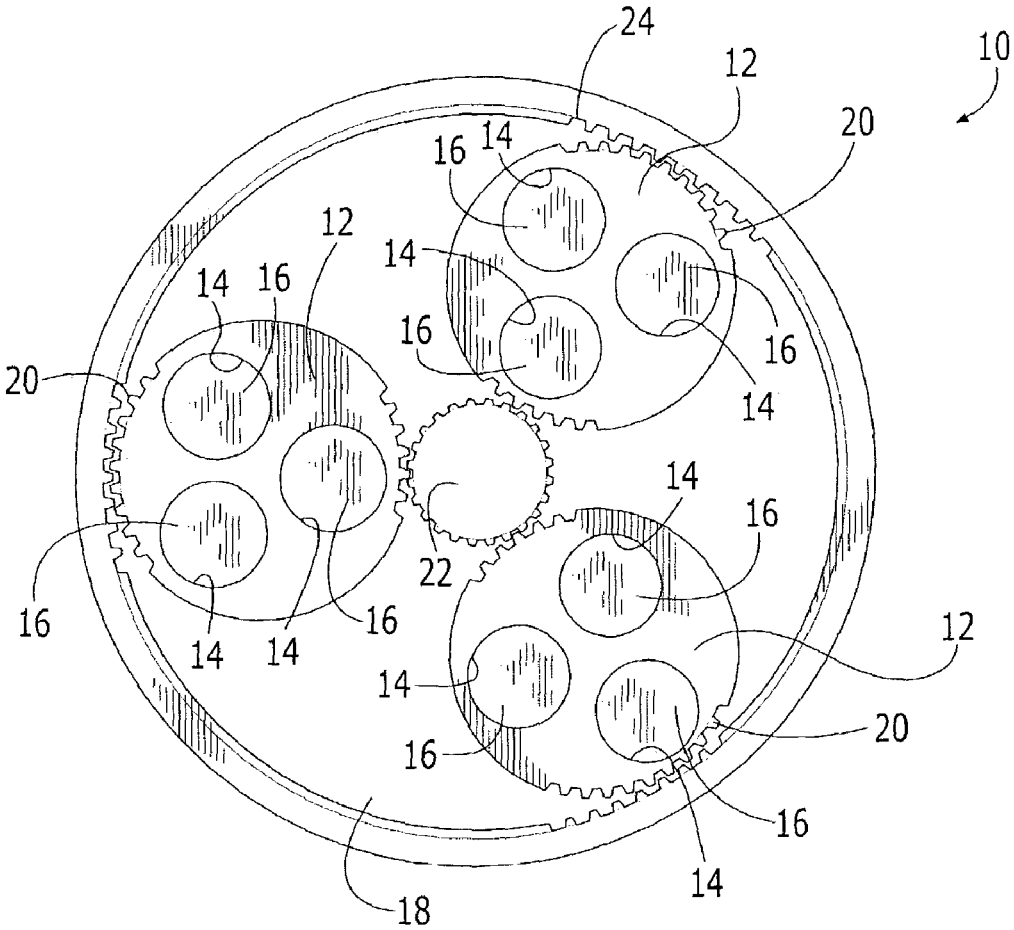
FIG. 1 is a top view of an apparatus for lapping a plurality of wafers including a plurality of lapping carriers disposed upon a lapping plate in which the top lapping plate has been removed to permit the lapping carriers to be seen.
Figure 2:
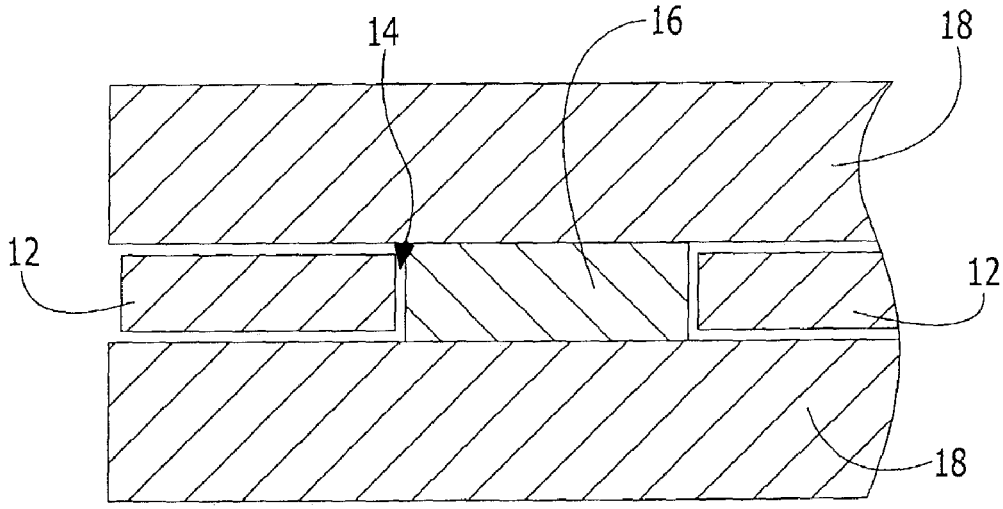
FIG. 2 is a fragmentary side cross-sectional view of a portion of a lapping carrier sandwiched between a pair of lapping plates.

As shown in FIG. 1, an apparatus 10 for lapping a wafer includes at least one and, more typically, a plurality of lapping carriers 12. Each lapping carrier defines at least one opening 14 and, more typically, a plurality of openings, for receiving respective wafers 16. The apparatus for lapping a wafer also includes at least one lapping plate 18 proximate the lapping carrier(s). Typically, the apparatus for lapping a wafer includes a pair of lapping plates disposed on opposite sides of the lapping carriers such that the lapping carriers are sandwiched therebetween. While one of the lapping plates, i.e., the upper lapping plate, has been removed in the top view depicted in FIG. 1 such that the lapping carriers can be seen, FIG. 2 depicts a portion of a lapping carrier disposed between a pair of opposed lapping plates.

As known to those skilled in the art, lapping plates 18 are generally relatively heavy steel plates such that the lapping carriers 12 and the wafers 16 carried thereby are subjected to relatively substantial compressive forces. By imparting relative motion between the lapping carriers and the lapping plates, such as by movement of the lapping carriers therebetween, the opposed surfaces of the wafers are lapped. To facilitate the lapping, a slurry comprised of abrasive particles disposed in a suspension solution is generally provided between the pair of opposed lapping plates, as also known to those skilled in the art.

As shown in FIG. 1, the lapping carriers 12 may include a plurality of teeth 20, such as gear teeth, disposed about and extending radially outward from the periphery thereof. Although the gear teeth of the lapping carriers may be engaged and driven in various manners, the lapping apparatus 10 may include a sun gear 22 that is centrally located relative to the lapping carriers and a ring gear 24 that extends peripherally about the plurality of lapping carriers. Rotation of the sun and ring gears, typically in the same direction but at different rotational speeds, therefore causes the lapping carriers to rotate, both about the center of each respective lapping carrier and the center axis defined by the sun and ring gears.

According to the present invention, the lapping carrier 12 is cryogenically tempered in order to advantageously increase the hardness of the lapping carrier. Prior to its cryogenic tempering, a workpiece is provided that will be processed to form the lapping carrier. Typically, the workpiece has a circular shape and may have various diameters, such as 20", 22", 30", and 32", for example. The workpiece is generally formed from a metallic material, such as sheet steel, that has a precisely controlled thickness, such as a thickness that varies by no more than +/−0.02 mm, such that the opposed surfaces of the lapping carrier are very flat.

As described below, however, the cryogenic tempering of the lapping carrier 12 and the attendant increase in the hardness of the lapping carrier provided by the cryogenic tempering permits the lapping carrier to be comprised of a material that is initially somewhat less hard than the material from which conventional lapping carriers are formed. For example, the workpiece may be formed of JIS SK-5 hard rolled steel or some other softer grade of steel since the hardness of the workpiece will be subsequently increased by the cryogenic tempering. By beginning with a workpiece that is somewhat less hard, however, the workpiece can be more easily and efficiently processed prior to its cryogenic tempering. Moreover, softer grades of sheet steel having the desired dimensional requirements and the desired widths are generally less expensive than harder grades of steel, especially for workpieces having larger widths, such as 30" or so.

Figure 3:
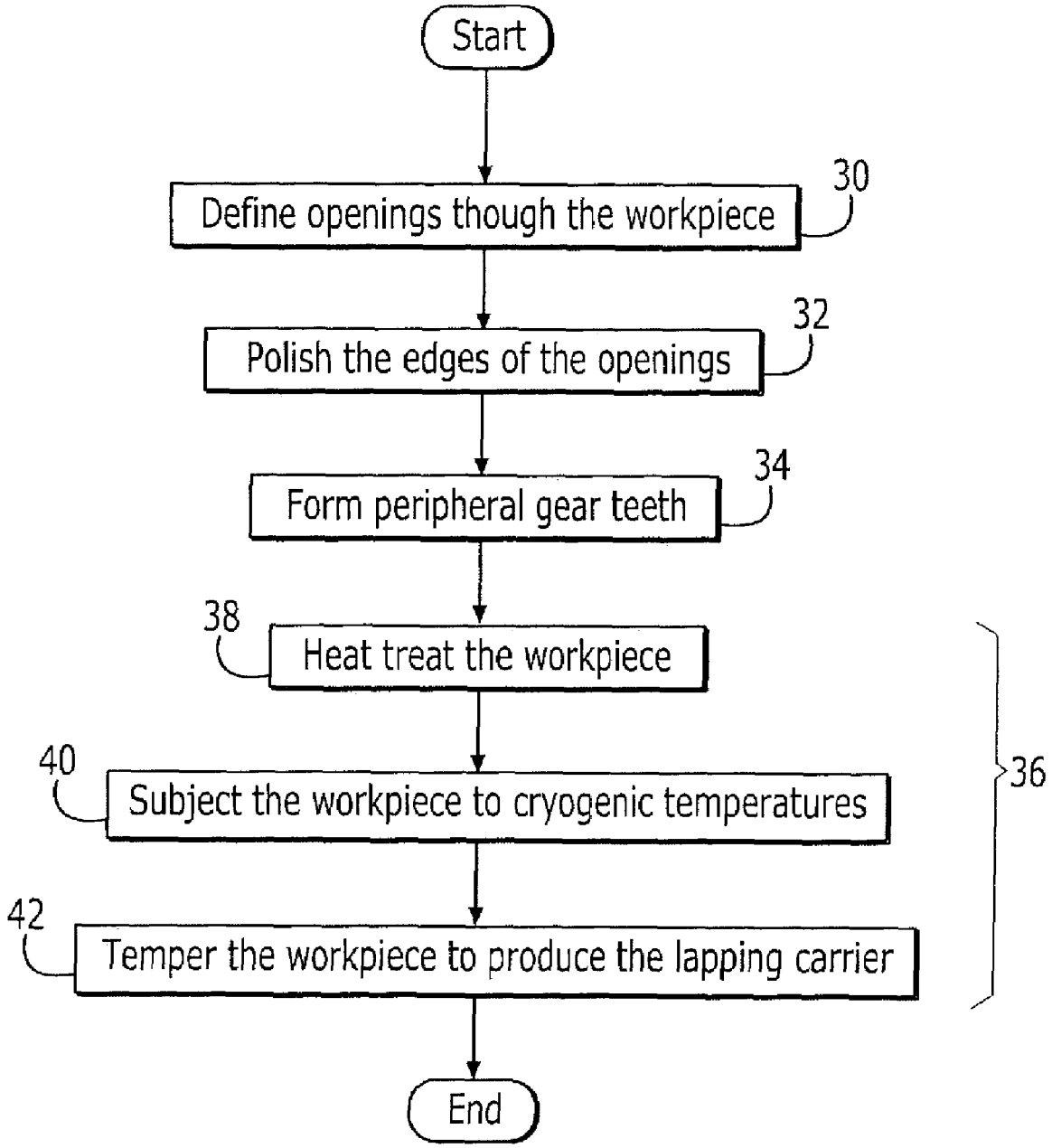
FIG. 3 is a flowchart illustrating the operations performed to fabricate a lapping carrier according to one embodiment of the present invention.

As shown in step 30 of FIG. 3, the method of one embodiment of the present invention defines at least one opening 14 extending through the workpiece. Typically, a plurality of openings are defined that extend through the workpiece as shown in FIG. 1. In order to permit double sided lapping of the wafers, the openings may extend completely through the workpiece. Moreover, the openings are sized to receive a wafer 16 and to permit the wafer to rotate freely therein.

The openings 14 may be defined through the workpiece in various manners including by punching the openings therethrough. The edge of the openings defined by the workpiece are generally polished to smooth the edge of the openings, as shown in step 32 of FIG. 3. Thus, contact between the edge of the wafers 16 and the edge of the respective openings within which the wafers are disposed during subsequent lapping operations will not roughen the edge of the wafers as much as if the edge of the openings defined by the lapping carrier were left unpolished. Either before or after the openings are defined, gear teeth extending outwardly from the circumferential edge of the workpiece may be formed, such as by laser cutting or punching. See step 34 of FIG. 3.

In accordance with the embodiment of the method depicted in FIG. 3 and, in particular, with reference to the group of steps collectively designated as 36, the workpiece is then cryogenically tempered to produce the lapping carrier 12. During the cryogenic tempering of the workpiece, the workpiece is subjected to a cryogenic temperature. See step 40. As known to those skilled in the art, a cryogenic temperature is typically defined as a temperature about −300° F., such as between −280° F. and −320° F. By cryogenically tempering the workpiece, a much larger percentage of the crystalline structure of the workpiece is converted from an austenite crystalline structure to a martensite crystalline structure, thereby increasing the hardness of the resulting lapping carrier. In this regard, a lapping carrier that has been cryogenically tempered generally has a crystalline structure, at least 70%, and more advantageously at least 90%, and even more advantageously at least about 99% of which has been converted to the martensite crystalline structure. In comparison, comparable workpieces subjected to conventional, non-cryogenic heat treating processes generally have a crystalline structure of which only about 60% is converted from an austenite crystalline structure to the martensite crystalline structure. By converting a much greater percentage of the crystalline structure to the martensite crystalline structure and, in fact, by advantageously converting virtually the entire crystalline structure to the martensite crystalline structure, the hardness of the crystalline structure is greatly improved.

Various cryogenic tempering processes may be utilized in order to cryogenically temper the workpiece to produce the lapping carrier 12 of the present invention. In one embodiment, the workpiece is quenched by taking the workpiece from room temperature to a cryogenic temperature, such as about −300° F. The workpiece is then held at the cryogenic temperature for a time sufficient for at least 70% and, more typically, at least 90%, and more advantageously at least about 99% of the crystalline structure to be converted to a martensite crystalline structure. The time at which the lapping carrier should be maintained at the cryogenic temperature will depend upon the thermal mass of the workpiece as well as the material that comprises the workpiece, as known to those skilled in the art.

As an alternative to directly cooling the workpiece from room temperature to a cryogenic temperature, the workpiece may be subjected to a plurality of thermal cycles, at least one of which is conducted at a cryogenic temperature. For example, the workpiece may initially be heat treated, such as by being heating to an elevated temperature, such as a temperature of about 250° F., for example, for a period of time sufficient for the internal temperature of the workpiece to stabilize. See step 38 of FIG. 3. The workpiece can then be subjected to a cryogenic temperature, such as about −300° F., for a time sufficient for at least 70% and, more typically, at least 90%, and more advantageously at least about 99% of the crystalline structure of the workpiece to convert to the martensite crystalline structure.

Once the workpiece has been subjected to the cryogenic temperature in either of the above described processes, the workpiece may be tempered as shown in step 42. This tempering may be performed by heating the workpiece to an elevated temperature, such as between about 280° F. and about 400° F. and, more particularly, to about 300° F., for a period of time sufficient to stabilize the internal temperature of the workpiece, such as one hour or more.

While two exemplary techniques for cryogenically tempering a workpiece are provided, the workpiece may be cryogenically tempered in other manners without departing from the spirit and scope of the present invention.

Although the method depicted by FIG. 3 defines the openings 14 through the workpiece and polishes the edges of the openings prior to cryogenically tempering the workpiece, the workpiece may initially be cryogenically tempered before forming openings therethrough. In this embodiment, the workpiece is cryogenically tempered as described above, with openings thereafter formed through the cryogenically tempered workpiece, such as by punching or the like. As before, the edges of the openings may then be polished. Additionally, teeth 20 may be formed about the periphery of the workpiece either before or after the cryogenic tempering of the workpiece. Since the cryogenic tempering of the workpiece hardens the workpiece, however, it may be more efficient to form the openings and the teeth prior to cryogenically tempering the workpiece since it will generally be easier to process the workpiece prior to its hardening.

Since the cryogenic tempering of the workpiece hardens the workpiece, the method of the present invention may permit the workpiece to be formed of a softer material than conventionally utilized for the smaller lapping carriers. In this regard, a different grade of steel, such as 1074 hard rolled steel, may be utilized since the subsequent cryogenic tempering of the workpiece will sufficiently harden the lapping carrier 12 even though the workpiece was initially somewhat softer. By utilizing a workpiece formed of a slightly softer material, the initial processing of the workpiece, such as in accordance with the embodiment depicted in FIG. 3 in which the openings 14 are defined, the edges of the openings are polished and the teeth 20 extending about the periphery of the workpiece are formed prior to the cryogenic tempering of the workpiece, may be performed more easily than comparable processing operations performed on harder workpieces. Additionally, a workpiece formed of a softer grade of steel is generally less expensive than the harder grades of steel from which lapping carriers are typically formed, particularly for workpieces that both must meet exacting dimensional requirements and be relatively wide.

According to the present invention, the hardness of the lapping carrier 12 can be controlled somewhat by controlling the extent to which the workpiece is cryogenically tempered. Thus, the time and expense required to cryogenically temper the workpiece may be traded off relative to the desired hardness of the resulting lapping carrier. Thus, lapping carriers that need not be as hard may be fabricated in a less expensive and more rapid manner by conducting only a limited cryogenic tempering of the workpiece, while lapping carriers that must be harder can be cryogenically tempered for a longer period of time in order to bring about a more complete conversion of the crystalline structure even though the additional cryogenic tempering will increase the requisite fabrication costs and time.

According to another aspect in the present invention, a lapping carrier 12 is provided having a carrier body defining at least one and, more typically, a plurality of openings 14 extending therethrough. The openings are sized to receive respective wafers 16 and generally have a diameter that is larger than the maximum allowable diameter of the wafers such that the wafers are free to rotate within the respective openings. According to this aspect of the present invention, the carrier body has a crystalline structure with at least 70% and, more typically, at least 90%, and more advantageously at least about 99% of the crystalline structure comprising a martensite crystalline structure. In this regard, the carrier body has generally been cryogenically tempered as described above to significantly increase the percentage of the crystalline structure that is converted to the martensite crystalline structure. As a result, the lapping carrier is advantageously harder than conventional lapping carriers.

According to yet another aspect to the present invention, an apparatus 10 for lapping a wafer is provided that includes a lapping carrier 12 as described above having at least one opening 14 for receiving a respective wafer 16 and having a crystalline structure with at least 70% and, more typically, at least 90%, and more advantageously at least about 99% of the crystalline structure comprising a martensite crystalline structure. According to this aspect of the present invention, the apparatus also includes as least one lapping plate 18 proximate the lapping carrier for lapping the wafers disposed within the respective openings defined by the lapping carrier. Advantageously, the apparatus is adapted for double sided lapping of the wafers, and, as such, may include a pair of lapping plates disposed on opposite sides of the lapping carrier. Since the openings defined by the lapping carrier of this embodiment extend completely through the lapping carrier, the opposed surfaces of the wafers contact a lapping plate and are lapped as the lapping carriers are moved relative to the lapping plates as a result of the mechanical abrasion between the slurry disposed between the lapping plates and the lapping carriers and the wafers carried by the lapping carriers.

Since at least 70% and, more typically, at least 90%, and more advantageously at least about 99% percent of the crystalline structure of the lapping carrier 12 has a martensite crystalline structure, typically as a result of the cryogenic tempering of the lapping carrier, the hardness of the lapping carrier may be controllably increased. As a result of this increased hardness, the edges of the openings 14 defined by the lapping carrier do not erode as rapidly as the edges of the openings defined by conventional lapping carriers formed of the same material.

Since the edge of the openings 14 defined by lapping carrier 12 of the present invention does not erode as rapidly, the lapping carrier also need not include inserts or rings defining the edge of the openings, although such inserts or rings may be utilized in conjunction with the lapping carrier of present invention if so desired. In the event that the lapping carrier does include the molded plastic rings, the increased hardness of the cryogenically treated lapping carrier will also make the lapping carrier stiffer and less susceptible to bending than conventional lapping carriers formed of the non-cryogenically treated material. Since the bending of the lapping carrier is reduced, the interface between the plastic ring or insert and the edge of the opening defined by the lapping carrier is subjected to less stress. As such, the integrity of the adhesion between the plastic ring or insert and the edge of the opening defined by the lapping carrier will be maintained more effectively, thereby advantageously reducing the possibility at which the plastic rings or inserts may separate from the steel carrier. Furthermore, in the event that the lapping carrier does include the manually applied plastic inserts, the extended service life of the cryogenically treated lapping carrier will also allow the plastic inserts to be manually applied more times. Since the useful life of the carrier is expended with each application of the manually applied plastic inserts, the cost of the carrier can be spread out through a longer service life, thus decreasing the overall capital cost of the lapping process.

Additionally, the lapping carrier 12 of the present invention does not thin as quickly during lapping operations as do conventional lapping carriers. In this regard, the increased hardness of the lapping carrier of the present invention resists reduction in the thickness of the lapping carrier during lapping operations. As a result of the decrease in the rate at which the edge of the openings defined by the lapping carrier erodes and the decrease in the rate at which the thickness of the lapping carrier is reduced, the lifetime of the lapping carrier of the present invention is increased relative to conventional lapping carriers formed of the same material. As a result, the capital costs associated with an apparatus 10 for lapping a wafer are reduced and the maintenance time required for the lapping apparatus to be down in order to replace the lapping carrier is advantageously reduced.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of fabricating a lapping carrier comprising;

defining at least one opening extending through a workpiece that is sized to receive a wafer; and cryogenically tempering the workpiece to produce the lapping carrier, wherein cryogenically tempering the workpiece comprises subjecting the workpiece to a cryogenic temperature for a sufficient time to convert at least 70% of the crystalline structure of the workpiece to a martensite crystalline structure.

2. A method according to claim 1 wherein subjecting the workpiece to a cryogenic temperature comprises subjecting the workpiece to a plurality of thermal cycles with at least one thermal cycle conducted at a cryogenic temperature.

3. A method according to claim 1 wherein cryogencially tempering the workpiece comprises converting at least about 99% of the crystalline structure of the workpiece to the martensite crystalline structure.

4. A method according to claim 1 wherein forming the workpiece comprises punching the at least one opening therethrough.

5. A method according to claim 1 wherein forming the workpiece comprises polishing an edge of the at least one opening defined by the workpiece.

6. A method of fabricating a lapping carrier comprising:

cryogenically tempering a workpiece by subjecting the workpiece to a cryogenic temperature for a sufficient time to convert at least 70% of the crystalline structure of the workpiece to a martensite crystalline structure; and forming at least one opening through the cryogenically tempered workpiece that is sized to receive a wafer.

7. A method according to claim 6 wherein cryogenically tempering the workpiece comprises subjecting the workpiece to a plurality of thermal cycles with at least one thermal cycle conducted at a cryogenic temperature.

8. A method according to claim 6 wherein cryogencially tempering the workpiece comprises converting at least about 90% of the crystalline structure of the workpiece to the martensite crystalline structure.

9. A method according to claim 6 wherein forming the at least one opening comprises punching the at least one opening through the cryogenically tempered workpiece.

10. A method according to claim 6 wherein forming the at least one opening comprises polising an edge of the at least one opening.

* * * * *